United States Patent [19]

Kendig

[11] Patent Number: 4,519,958

[45] Date of Patent: May 28, 1985

[54] FUEL FLOW METERING APPARATUS

[75] Inventor: Willard Z. Kendig, Yettem, Calif.

[73] Assignee: Kenna Research Corporation, Tustin, Calif.

[21] Appl. No.: 626,367

[22] Filed: Jun. 29, 1984

Related U.S. Application Data

[62] Division of Ser. No. 387,901, Jun. 14, 1982, Pat. No. 4,482,507.

[51] Int. Cl.[3] ..... F02M 7/22

[52] U.S. Cl. ..... 261/50 A

[58] Field of Search ..... 261/DIG. 56, 50 A, 39 D, 261/67, 39 E

[56] References Cited

U.S. PATENT DOCUMENTS

| | | | |
|---|---|---|---|
| 1,063,866 | 6/1913 | Filson | 261/DIG. 56 |
| 1,369,419 | 2/1921 | Gibford | 261/67 |
| 1,822,712 | 9/1931 | Skinner | 261/44 C |
| 1,940,251 | 12/1933 | Hammond | 261/DIG. 56 |
| 1,974,286 | 9/1934 | Monosmith et al. . | |
| 2,088,464 | 7/1937 | Chandler et al. | 261/DIG. 56 |
| 2,236,595 | 4/1941 | Fish . | |
| 2,468,416 | 4/1949 | Stresen-Reuter | 261/DIG. 56 |
| 3,284,062 | 11/1966 | Obermeyer, Jr. . | |
| 3,291,464 | 12/1966 | Hammerschmidt et al. . | |
| 3,342,462 | 9/1967 | Mick . | |
| 3,695,589 | 10/1972 | Lamore | 261/50 A |
| 3,752,451 | 8/1973 | Kendig . | |
| 3,931,368 | 1/1976 | Barker et al. | 261/DIG. 56 |
| 4,052,488 | 10/1977 | Shoeman | 261/50 A |
| 4,056,583 | 11/1977 | Shinoda et al. | 261/DIG. 56 |
| 4,206,735 | 6/1980 | Miles et al. | 261/50 A |
| 4,283,355 | 8/1981 | Herd, Jr. et al. | 261/DIG. 56 |
| 4,461,731 | 7/1984 | Herd, Jr. et al. | 261/50 A |

FOREIGN PATENT DOCUMENTS

| | | | |
|---|---|---|---|
| 411639 | 6/1934 | United Kingdom | 261/67 |

*Primary Examiner*—Tim Miles

*Attorney, Agent, or Firm*—Nilsson, Robbins, Dalgarn, Berliner, Carson & Wurst

[57] ABSTRACT

A carburetor which is responsive to an operator controlled throttle includes a fuel metering and dispersion system for optimally mixing a fuel with air in preparation for the injection into the intake manifold of an internal combustion engine. The carburetor includes a housing with an air-fuel mixing passageway extending vertically therethrough and a fuel dispersion bar transverse to the air-fuel mixing passageway with a plurality of fuel dispersion openings therein for injecting fuel into the air-fuel mixing passageway transverse to the flow of air. A fuel pressure controlled spool valve in the dispersion bar varies the amount by which the fuel dispersion openings are opened in response to the volume of fuel entering the dispersion bar. Venturi plates upstream of the fuel dispersion bar are pivotally attached for variably opening and closing the air-fuel passageway. Throttle valve means are pivotally mounted in the air-fuel mixing passageway adjacent the fuel dispersion openings for variably opening and closing the space between the fuel dispersion openings and the throttle valves. A metering valve assembly is linked to the venturi plates for variably regulating the flow of fuel from a fuel reservoir into the dispersion bar so that the amount of fuel metered into the dispersion bar increases as the space between the venturi plates increases according to a predefined determined metering criteria.

4 Claims, 12 Drawing Figures

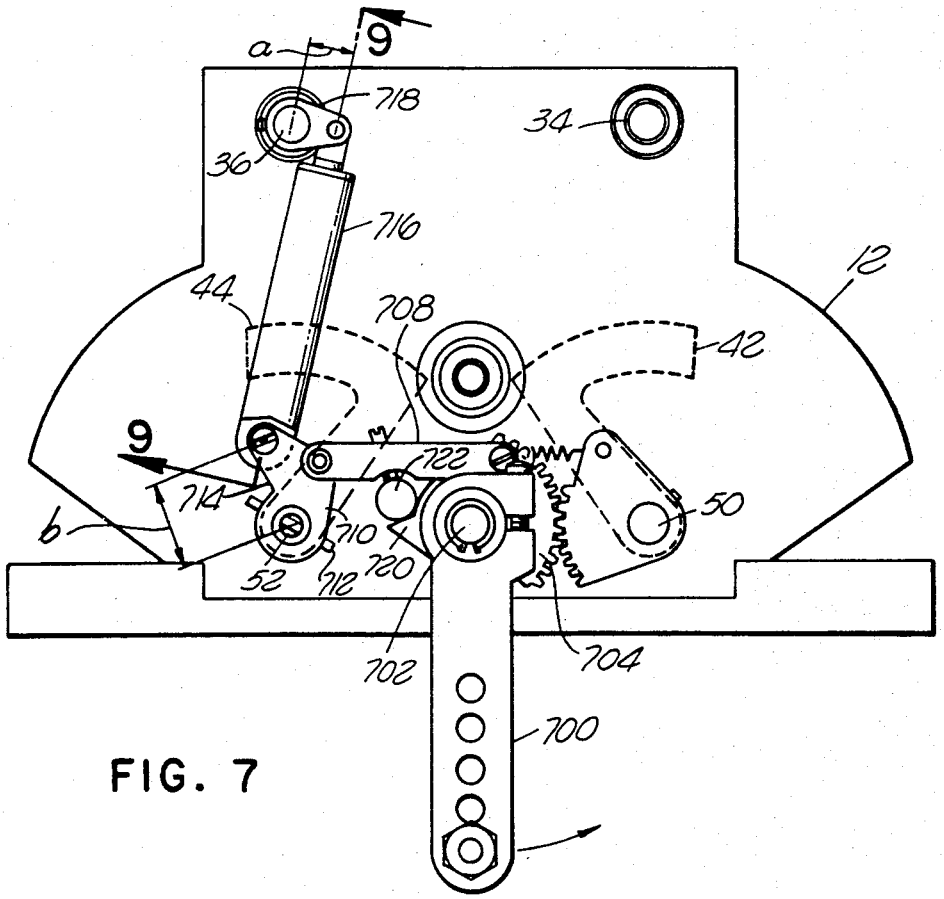
FIG. 7
FIG. 8
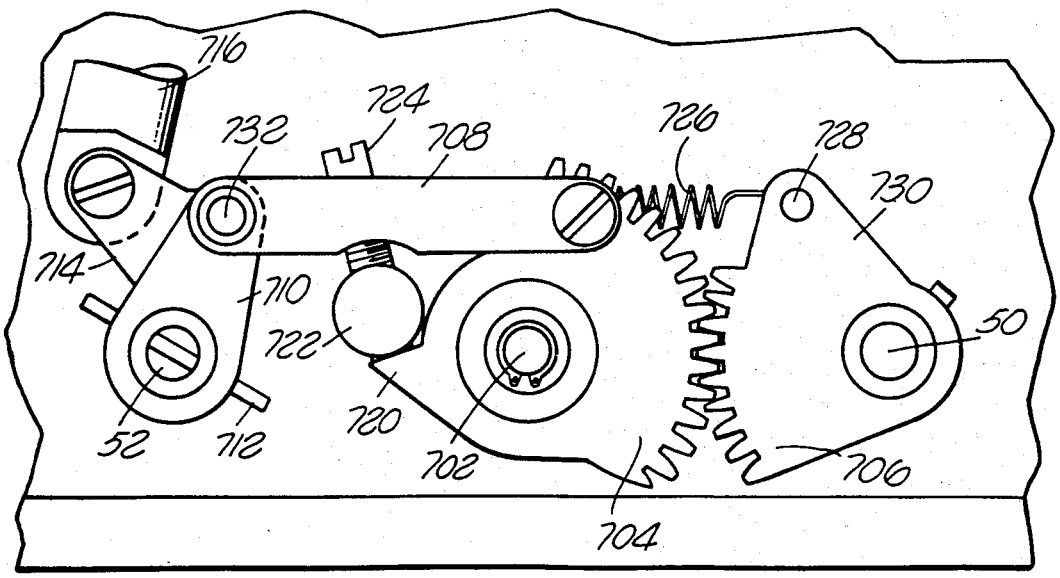

FUEL FLOW METERING APPARATUS

This is a division, of application Ser. No. 387,901 filed June 14, 1982, now U.S. Pat. No 4,482,507.

BACKGROUND

The present invention relates to carburetors for internal combustion engines and in particular to fuel metering and dispersion systems for controlling the air-fuel mixture in a carburetor.

Carburetor metering systems have generally been employed for the purpose of maintaining a constant air fuel ratio over a broad range of throttle positions. For example, in Monosmith, et al., Pat. No. 1,974,286 an air valve is linked to a fuel flow valve so that an increase in air flow causes a proportionate increase in the amount of fuel injected. However, this carburetor does not use a spool valve for regulating fuel injection into the carburetor mixing chamber nor is it capable of precise fuel metering. In addition, the Monosmith patent does not provide a structure wherein the fuel is injected into the airflow at the point of maximum air flow velocity, i.e., at the narrowest point or throat in the air-fuel mixing passageway. Monosmith, et al., does incorporate a dash-pot-like device for enriching the air-fuel ratio on rapid acceleration or cold starting.

The fuel metering system disclosed in Fish Pat. No. 2,236,595, has a fixed venturi area and a throttle plate pivotally mounted in the air-fuel mixing passageway of the carburetor. However, the fuel discharge openings are on a pivotal throttle member which makes it impossible for the fuel to be dispersed at the narrowest portion of the air-fuel mixing passageway at all throttle positions as in the present invention. In addition, fuel metering is accomplished by a pivotal arm attached to the throttle plate which extends into the fuel chamber. A passageway from the throttle plate apertures through the radial arm terminates at the end of the arm in spaced varying relationship to the carburetor wall so that as the arm is rotated the orifice area increases to permit greater fuel flow. In such a carburetor, the rate of fuel delivery may be matched to the position of the throttle plate. However, this carburetor suffers from the disadvantage that the venturi area is fixed (at a given throttle setting) and thus the air flow is not responsive to engine demands.

A carburetor having an adjustable fuel metering means similar to that disclosed in the Fish patent is also disclosed in Hammerschmidt et al., Pat. No. 3,291,464.

Other fuel metering systems are disclosed in Obermeyer, Jr. Pat. No. 3,284,062 and Mick Pat. No. 3,342,462. Each of these fuel metering systems provide a link between the air valve and a fuel flow control mechanism so that the greater the opening of the air valve the greater will be the amount of fuel injected into the air-fuel mixing passageway. While each of these devices has certain advantages, each fails to provide the precision fuel metering necessary to effect optimal air fuel mixing over a wide range of operating conditions thus resulting in sub-optimal fuel economy and higher than necessary pollution. Additionally, the injection of fuel does not occur at the location of maximum air velocity, namely at the narrowest point or throat of the air-fuel passageway over the entire range of throttle openings as in the present invention.

In an effort to solve these problems and provide a more precision fuel metering system, the inventor herein previously invented a carburetor fully described in U.S. Pat. No. 3,752,451, which provides a fuel spray bar in a mixing passageway between a pair of venturi plates in the upstream portion of the mixing passageway of the carburetor and a pair of throttle plates in the downstream portion of the mixing passageway. Fuel is supplied to the fuel spray bar in the mixing passageway by a pivotal fuel dispersing pickup arm, which moves over a calibrated metering ramp in the fuel chamber to form a variable fuel metering clearance between the metering ramp in the fuel dispersing pickup arm. The movable venturi plates and the pickup arm are linked to provide for concurrent pivotal movement of the two. The ramp in the fuel chamber which is variably spaced from the pickup arm opening, cooperated with the pickup arm opening to provide a non-linear variable fuel metering clearance so as to maintain the air fuel mixture ratio in the mixing chamber substantially constant. However, the fuel is again injected above the carburetor throat (between the throttle plates) in an area of lesser air velocity.

Unlike any of the above referenced carburetor and systems for fuel metering the present invention provides a carburetor where the fuel dispersion orifices are located transversely opposite the edge of a pair of throttle plates which is the narrowest point along the air-fuel mixing passageway for all throttle positions. This assures that the fuel will always be injected into the air stream through the carburetor at the point of maximum air flow velocity.

In addition, the present invention includes a variable radius metering arm which variably opens and closes a ball valve in response to the opening of a pair of venturi plates to allow fuel to pass from a reservoir into a fuel dispersion assembly. The contour of the cam surface of the variable radius metering cam against which the ball valve assembly presses is selected empirically over a range of operating conditions whereby the amount of fuel metered to the fuel dispersion assembly is optimized at each of a number of throttle positions with the contour of the variable radius metering arm being derived therefrom. In addition, the steady state closure position of the ball valve can be adjusted by incorporation of a valve adjustment sleeve, which is movable upwardly or downwardly in response to the turning of a valve closure adjustment shaft, to thereby increase or decrease the steady state ball valve opening. Such an arrangement allows for substantially greater precision without the necessity of a large number of precision parts.

The present invention also provides a unique on-off flow controlled valve which allows fuel to flow into the reservoir only upon initial pivoting of one of the venturi plates. Only slight initial rotation of one of the venturi plates is required to actuate the on-off fuel flow control valve to the fully opened position to allow fuel to flow into the reservoir.

In accordance with another further advantage of the present invention, float valves and the like are unnecessary because the system incorporates and takes advantage of the fuel pressure to additionally control dispersion of the fuel into the air-fuel mixing passageway. More specifically, the fuel entering the carburetor initially enters through a pressure regulator which maintains the pressure of fuel at a constant pressure of about four pounds per square inch. Thus, fuel in the system and particularly in the reservoir will be under pressure. Thereafter, the fuel is metered to a fuel dispersion assembly which includes a fuel dispersion bar with a flow passageway extending tranversely across the chamber of the carburetor. The fuel dispersion bar has a cylindrical flow passageway with a plurality of fuel dispersion slits which extend radially out from the flow passageway exiting into the air-fuel mixing passageway in a direction transverse to the direction of air flow through the carburetor. A spool valve extends through the flow passageway to variably open and close the plurality of fuel dispersion slits to vary the amount of fuel dispersed into the air-fuel mixing passageway in response to a fuel flow diaphragm which moves in response to the volume and pressure of the fuel flowing through the carburetor.

The throttle plates are positioned to close against the lateral or side facing apexes of the dispersion bar so that the velocity of the air passing through the carburetor will be greatest at the point of fuel injection into the air-fuel mixing passageway.

The fuel discharged from the fuel dispersion bar is discharged at a constant pressure by incorporating a fuel pressure control assembly. Specifically, the fuel passing through the fuel metering rod is applied against one side of a diaphragm where the other side of the diaphragm has a compression spring which applies a desired force so that as the volume of fuel flow into the dispersion bar increases the diaphragm will be deflected to open the spool valve and allow more fuel to be discharged through the dispersion slits so that the fuel pressure will be maintained at a constant value. On the other hand, if the flow of fuel decreases, the diaphragm deflects in the opposite direction, thereby closing the dispersion slits. The spool valve therefore enables the carburetor in accordance with the invention to more precisely discharge fuel into the mixing chamber.

Tests with a carburetor manufactured in accordance with the invention have been conducted and have demonstrated that substantially higher air-fuel ratios are possible to achieve the same performance which conventional carburetors yield, that fuel economy is greatly increased, and that undesired pollution is greatly decreased.

SUMMARY OF THE INVENTION

A carburetor in accordance with the invention is responsive to actuation of an operator controlled throttle for mixing a fuel from a storage tank with air and injecting the mixture into the intake manifold of an internal combustion engine. The carburetor includes a carburetor housing having an air-fuel mixing passageway therethrough and a dispersion bar mounted to the housing in the air-fuel mixing passageway to extend transversely to the direction of air flow through the air-fuel mixing passageway. The dispersion bar has a plurality of fuel dispersion openings or slits through which fuel is discharged into the air-fuel mixing passageway in a direction which is transverse to the direction of air flow through the carburetor. A spool valve rod is provided in the dispersion bar for regulating the flow of fuel passing through the fuel dispersion openings. The spool valve is actuated in response to variation in the volume of fuel metered into the dispersion bar so that the fuel pressure is maintained substantially constant. A pair of venturi plates are positioned upstream of the dispersion bar adjacent the air intake opening in the air-fuel mixing passageway for variably opening and closing in response to the air flow vacuum upstream of the vehicle throttle to thereby regulate the discharge of fuel into the air stream. A throttle valve means is also pivotally mounted in the air-fuel mixing passageway immediately and transversely adjacent the fuel dispersion openings for variably opening and closing to thereby vary the space between the fuel dispersion openings and the surfaces of the pair of throttle valves. The carburetor further includes a fuel reservoir having an input port and an exit port and a metering valve assembly for variably regulating the flow of fuel from the fuel reservoir into the dispersion bar in response to the amount by which the venturi means is opened or closed.

In accordance with the invention, the carburetor may further include an on-off flow control valve which is coupled between the fuel storage tank and the fuel reservoir which is opened in response to rotation of the venturi plates. Additionally, a fuel pressure regulator is coupled between the fuel storage tank and the on-off flow control valve for limiting the pressure of the fuel entering the carburator through the on-off flow control valve.

An anticipator link is also provided between the venturi plates and the throttle valves to enable the air fuel mixture to be enriched when it is desired to accelerate rapidly. Specifically, the anticipator link interconnects the venturi plates with the throttle valve so that rapid displacement of the throttle valve will cause the venturi plates to open but by a greater amount. If the throttle valve is opened slowly, however, the anticipator link will not cause movement of the venturi plates. Rather the movement of the venturi plates will be under the control of the air flow vacuum upstream of the throttle plates.

BRIEF DESCRIPTION OF THE DRAWINGS

A complete understanding of the present invention and of the above and other advantages and features thereof may be gained from a consideration of the following description of the preferred embodiments taken in conjunction with the accompanying drawings in which:

FIG. 7 is a cross-sectional end view through section 7—7 of FIG. 2;

FIG. 8 is a partial cross-sectional end view illustrating the throttle valve linkage;

DETAILED DESCRIPTION

Figure 1:
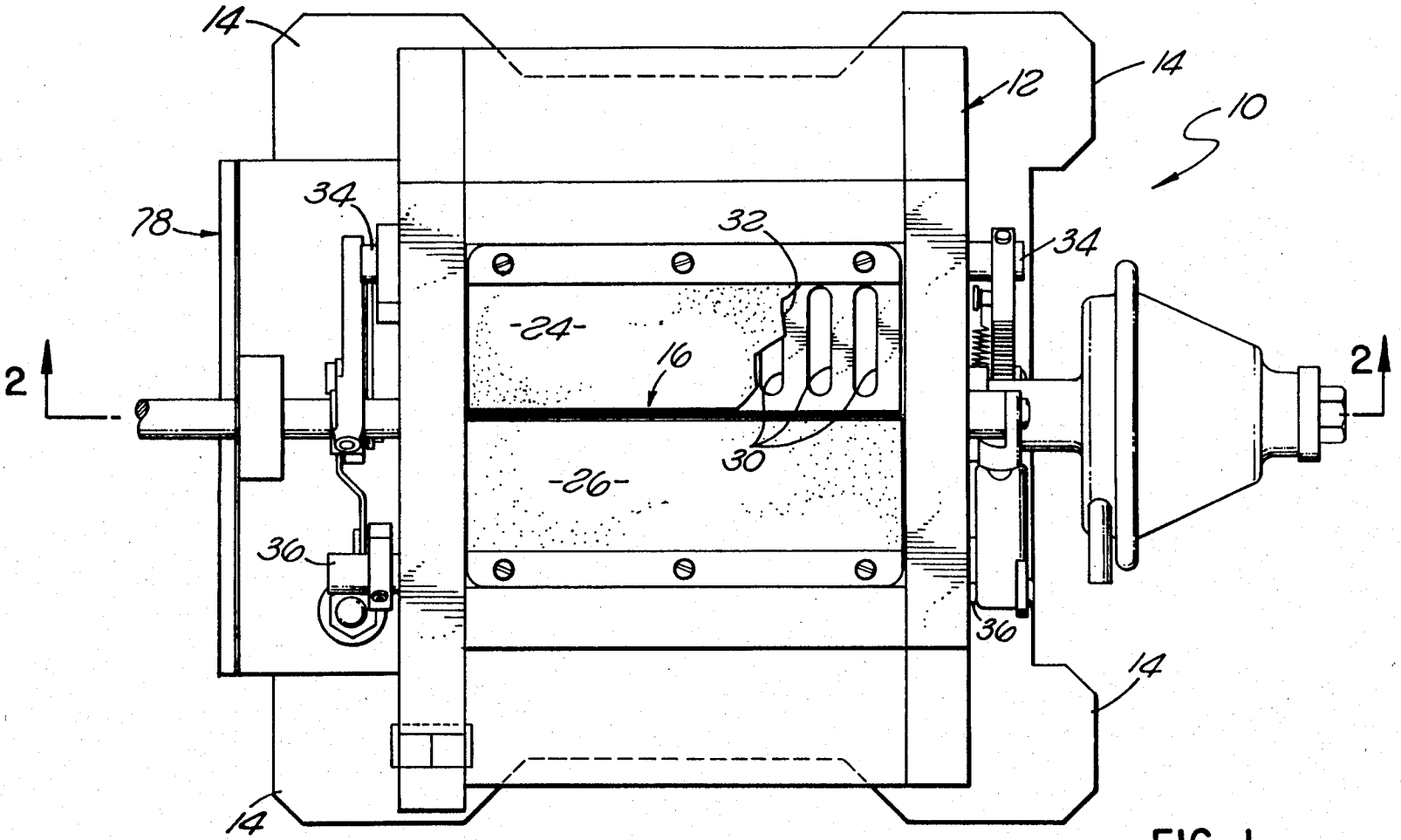
FIG. 1 is a top plan view of a carburetor in accordance with the invention.
Figure 2:
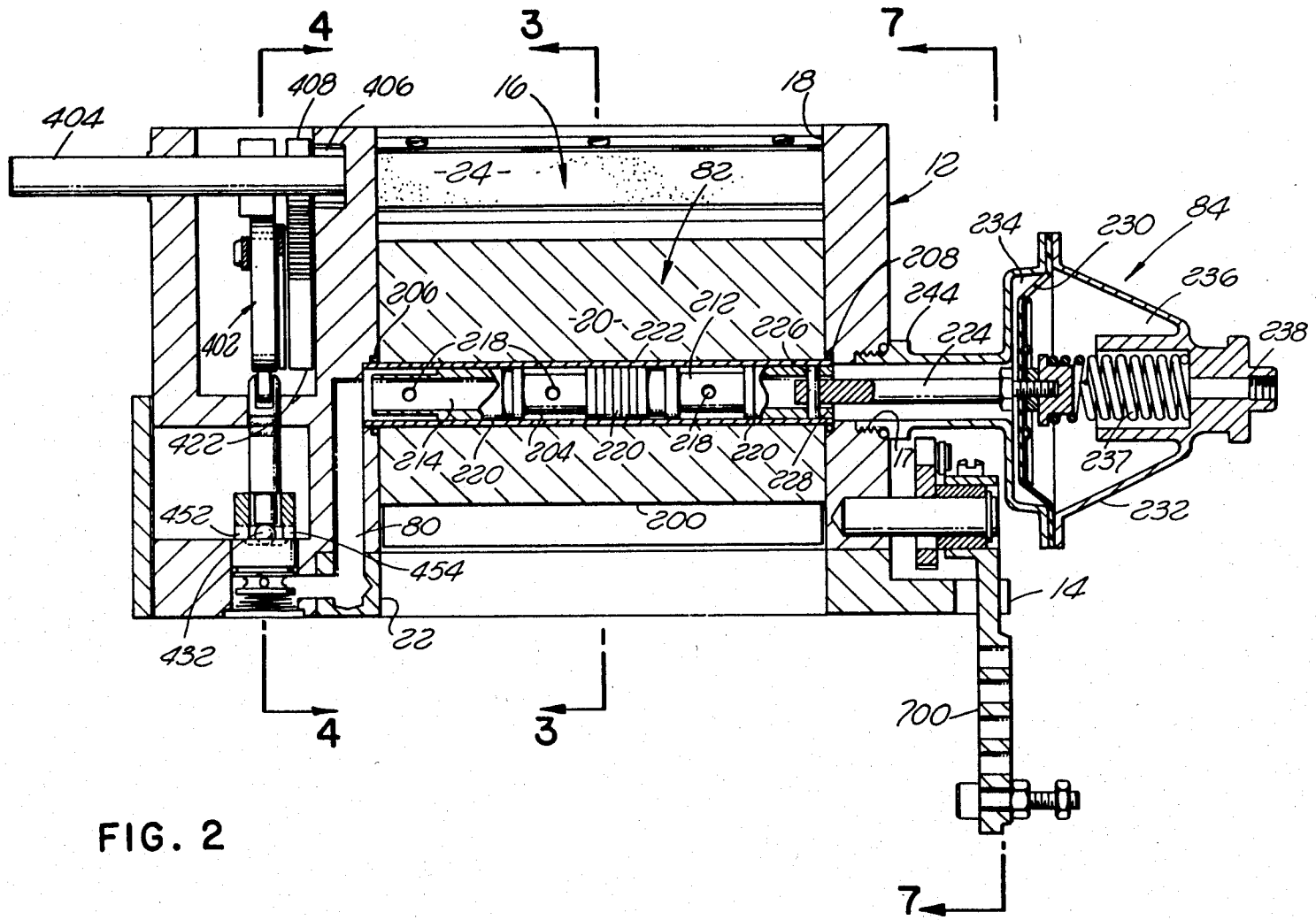
FIG. 2 is a side cross-sectional plan view through the center of the carburetor to illustrate the spool valve fuel control mechanism and the fuel metering assembly.

Referring initially to FIGS. 1 and 2, a carburetor 10 in accordance with the invention includes a carburetor housing 12 with a plurality of mounting flanges 14 by which the carburetor 10 may be bolted to the intake manifold of an internal combustion engine (not shown). The carburetor housing 12 has a mixing passageway 16 therethrough, commencing with an air intake opening 18 at the topmost portion of the carburetor 10, an air-fuel mixing region (throat) 20 in the center of the mixing passageway 16 and an air-fuel discharge opening 22 at the bottom of the carburetor housing 12 adjacent the mounting flanges 14.

In operation, air is drawn in through the air intake opening 18 and passes into the mixing passageway 16 where the air is mixed with atomized and vaporized fuel in the air-fuel mixing region 20. The resultant air-fuel mixture is drawn out from the air-fuel discharge opening 22 to pass into the intake manifold and thereafter into the cylinders of the internal combustion engine.

Figure 3A:
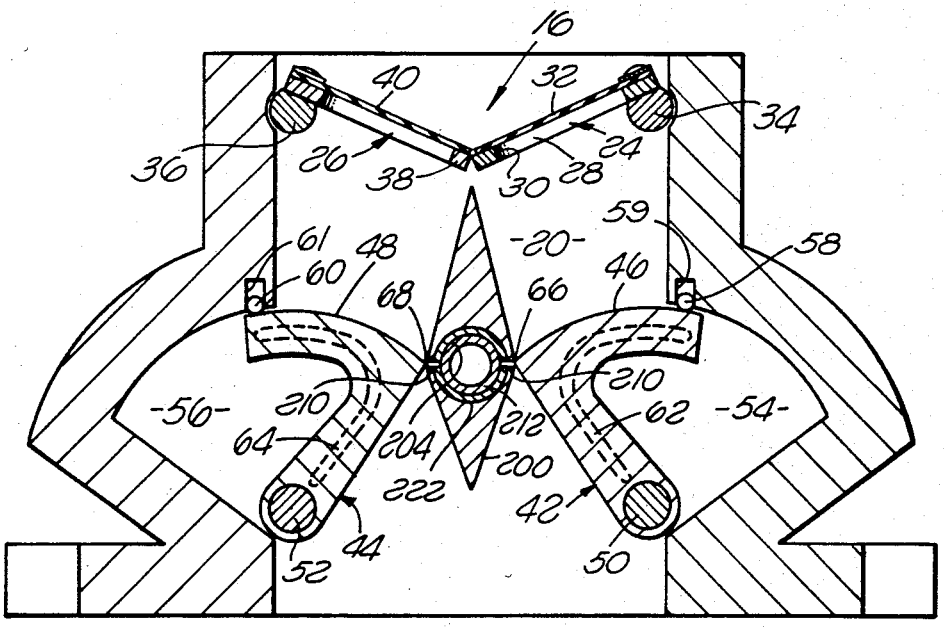
FIG. 3*a* is a side cross-sectional plan view through section 3—3 of FIG. 2 where the venturi plates and the throttle valves are in the closed position.
Figure 3B:
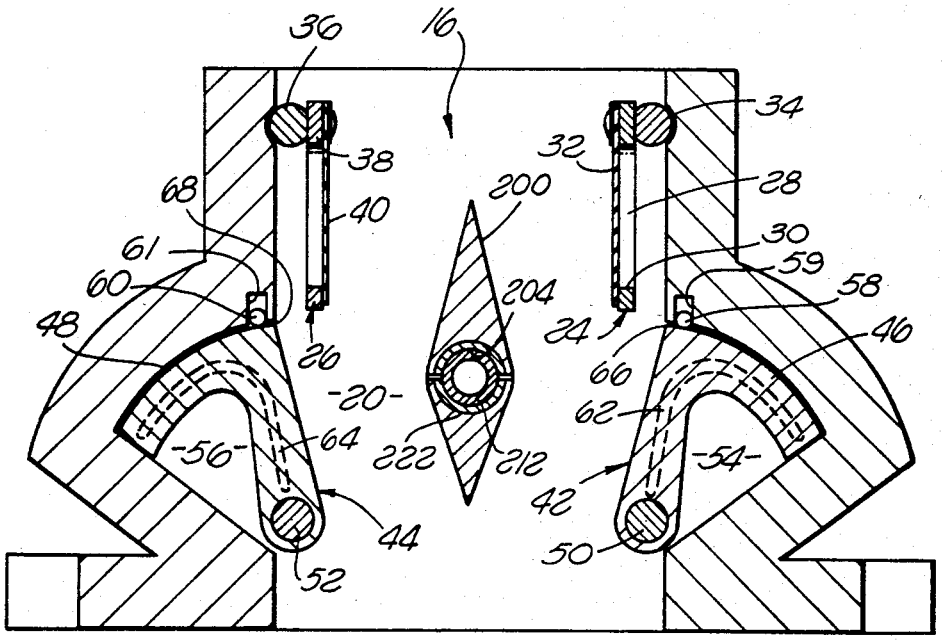
FIG. 3*b* is a side cross-sectional plan view through section 3—3 of FIG. 2 where the throttle valves and the venturi plates are in a fully opened position.

A pair of air valves also referred to herein as venturi plates 24 and 26, are pivotally mounted adjacent the air intake opening 18 in the mixing passageway 16. Referring to FIG. 3*a* and 3*b* in conjunction with FIGS. 1 and 2, the venturi plate 24 includes a rigid plate 28 with a plurality of orifices or slots 30 therethrough. A backfire flap 32 is mounted on the top side of the rigid plate 28 to cover the plurality of slots 30. The backfire flap 32 and the plate 28 are mounted to an air valve shaft 34 using suitable screws or the like. The shaft 34 extends through opposite sides of the carburetor housing 12 in the uppermost portion of the mixing passageway 16 as shown in FIG. 1. The air valve shaft 34 is interconnected to pivot counterclockwise as viewed in FIGS. 3*a* and 3*b* so that the plate 28 pivots downwardly, thereby variably opening the venturi plate to allow air to pass into and through the mixing passageway 16. An analogous structure is provided for the venturi plate 26, having a rigid plate 38 and a backfire flap 40 attached thereto and which is attached to an air valve shaft 36 on the opposite side of the mixing passageway 16 from the positioning of the air valve shaft 34.

In operation, the air valve shafts 34 and 36 are linked to pivot in opposite directions so that as the air valve shaft 34 pivots in a counterclockwise direction the air valve shaft 36 pivots in a clockwise direction.

In the event that there is a backfire through the carburetor 10, the resilient flap 32 and 40 will pivot upwardly away from the rigid bases 28 and 38 allowing the back pressure to escape through the slots without damaging the venturi plates 24 or 26.

In addition to the venturi plates 24 and 26, the carburetor 10 includes a pair of pivotally mounted throttle valves 42 and 44, which are linked to pivot together so that when the valve 42 pivots counterclockwise the valve 44 pivots clockwise. The throttle valves 42 and 44 are directly interconnected to the throttle of the vehicle to vary the width of the throat 20 of the mixing passageway 16. The throat 17 as used herein refers to the location along the air-fuel mixing passageway between the throttle plate edges at which the air-fuel mixing passageway is generally narrowest and through which the air velocity is generally greatest.

Figure 4:
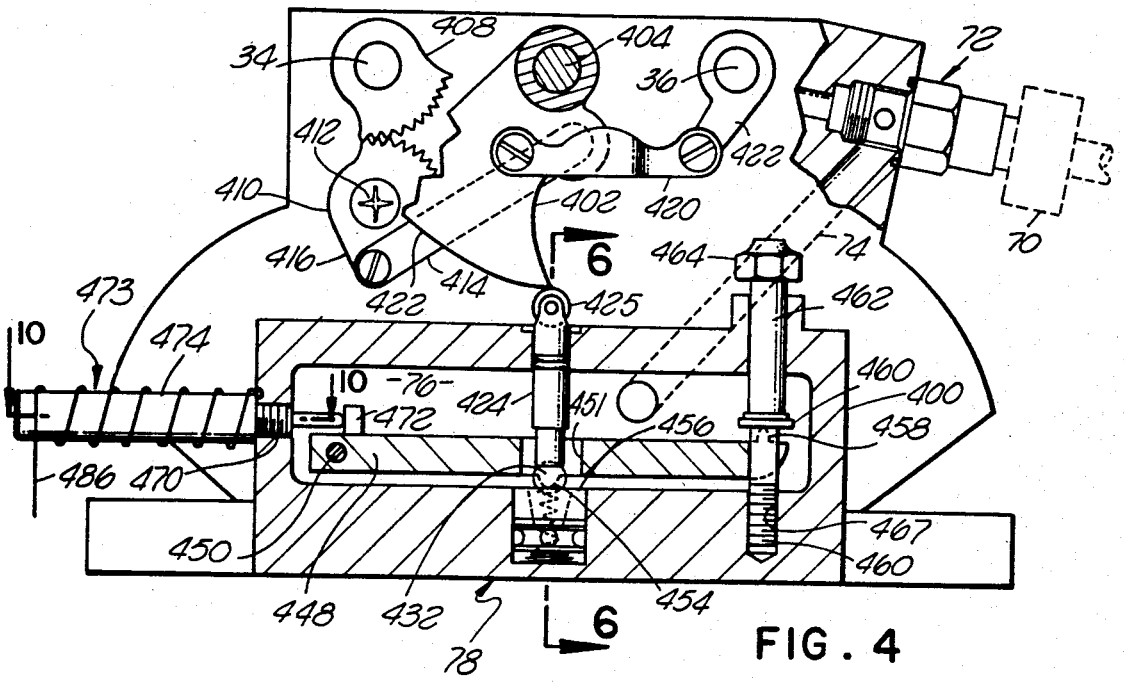
FIG. 4 is a side cross-sectional plan view through section 4—4 of FIG. 2 showing the metering valve assembly.

Referring to FIG. 4, fuel is pumped from a storage tank by a suitable fuel pump (not shown) through a fuel pressure regulator 70 into an on-off valve 72. The on-off valve 72 is closed when the venturi plates 24 and 26 are closed, i.e., when the engine is not running, but is opened allowing the flow of fuel through the on-off valve 72 when the venturi plates 26 and 24 are even slightly rotated by either the rapid opening of the throttle valves or by the negative air pressure upstream of the throttle valve caused by the operation of the internal combustion engine.

Fuel passing through the on-off valve 72 passes into a fuel intake passageway 74 which discharges into a fuel reservoir 76. The fuel is metered by a fuel metering assembly 78 from the reservoir 76 into a fuel dispersion assembly 82 which disperses the fuel into the throat of the air-fuel mixing passageway 16. The amount of fuel exiting the fuel dispersion assembly 82 is controlled by a spool valve extending through the fuel dispersion assembly 82.

Figure 5:
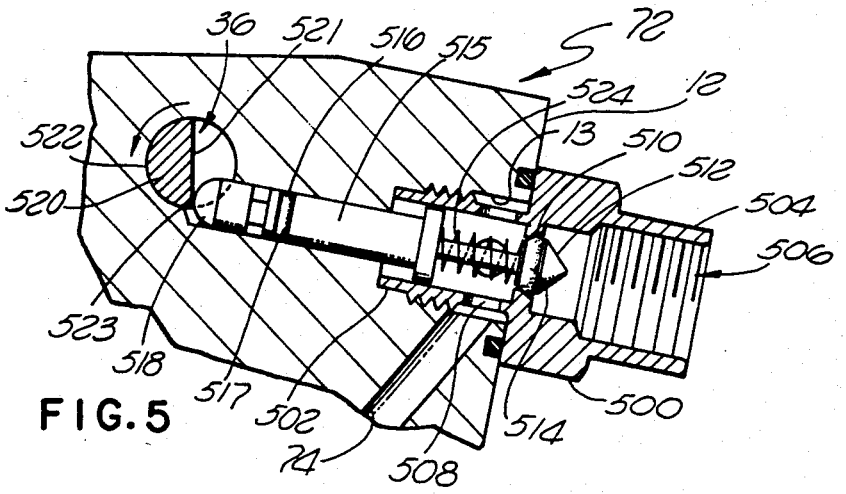
FIG. 5 is a partial side cross-sectional plan view showing the on-off flow control valve in accordance with the invention.

Referring more specifically to FIG. 5, one specific on-off valve 72 which can be utilized in accordance with the invention includes a valve housing 500 with an externally threaded first end 502 which is inserted into a mating, internally threaded hole 13 in the carburetor housing 12 and an internally threaded fuel inlet boss 504. A passageway 506 extends through the valve housing 500. A plurality of radially extending openings 508 allow the fuel to flow through the passageway 506 and into the fuel intake passageway 74 when the on-off valve 72 is open.

A constriction 510 is provided in the passageway 506 between the inlet boss 504 and the exit ports 508 with a suitable ring valve 512 with a ring seal 514 positioned in the passageway 506 so that the ring seal 514 seats against the constriction 510 to close the passageway 506 to the passage of fuel. The ring valve 512 is connected to one end of an actuating rod 515 which extends through the threaded hole 13 in the carburetor housing 12 with a suitable O-ring seal 516 positioned in a groove 517 in the actuating rod 515 to prevent fuel from flowing in the region between the actuating rod 515 and the carburetor housing 12.

Attached to the end of the actuating rod 515 opposite the ring valve 512 is a ballbearing 518 which seats against a cam region 520 in the air valve shaft 36. In accordance with the preferred embodiment and to enable the valve 512 to be opened from a closed position with only slight rotation of the venturi plate 24, the cam region 520 has a halfmoon or semicircular cross-sectional shape with a flat cam surface 521 and a circular cam surface 522. The ball bearing 518 is positioned to seat against one edge 523 of the flat cam surface 521 when the venturi plates are pivoted to a fully closed position. In such a position, a spring 524 maintains the ring valve seal 514 in a seated closed position against the constriction surface 510.

When the venturi plate is rotated to an open position the air valve shaft 36 will rotate in a counterclockwise direction as viewed in FIG. 5 causing the edge 523 of the cam surface 521 to press against the ball bearing 518 thereby moving the actuating rod 515 longitudinally in the hole 13. The longitudinal movement of the actuating rod 515 causes the valve seal 514 to move away from the construction 510 thereby opening the valve 72. As the shaft 36 continues to rotate the bearing 518 will come in contact with and press against the curved cam portion 522 and the valve 512 will not move and will remain in the open position. The spring 524 is compressed so that when the air valve shaft 36 is rotated clockwise the spring 524 will cause the ball bearing 518 to press against circular cam surface 522 until the bearing 518 reaches the edge 523 at which time the rod 515 will snap inwardly causing the valve seal 514 to again come in contact with the constriction surface 510 thereby closing the valve. Because of the initial orientation of the ball bearing 518 against the edge portion of the flat cam surface 520, only slight rotational movement of the air valve shaft 34 will cause substantial longitudinal movement of the actuating rod 514 to fully open the ring valve 512.

Referring to FIGS. 2 and 5, fuel passes through the on-off valve 72 into the fuel intake passageway 74 which has an exit port in the fuel reservoir 76. The fuel reservoir 76 is a chamber inside a metering valve housing 400. The metering valve assembly 78 further comprises a metering cam 402 which is fixed to a pivot shaft 404 pivotally mounted to one end of the carburetor housing 12 utilizing a suitable pressfit bearing 406. An upper sector gear 408 attached to the air valve shaft 34 intermeshes with a lower sector gear 410 which is pivotal about a fixed mounting shaft 412. A connecting link 414 is pivotally attached to a mounting flange 416 extending from one edge of the lower sector gear 410. The connecting link 414 is pivotally interconnected to a suitably positioned connecting flange 418 extending from one side of the metering disc 402. Thus, when the air valve 34 pivots in a clockwise direction the lower sector gear 410 will be rotated in a counterclockwise direction by the upper sector gear 408 which will cause the connecting link 414 to move longitudinally upwardly, causing the metering cam 402 to move in a counterclockwise direction as viewed in FIG. 4.

In order to interconnect the air valve shaft 36 with the air valve shaft 34 to cause the venturi plates 24 and 26 to move together (one in a clockwise direction and the other in a counterclockwise direction respectively) an additional connecting link 420 is interconnected between a suitable location on the metering cam 402 and one end of another connecting link 422 which is fixed to rotate with the air valve shaft 36. Thus, as the metering cam 402 is rotated counterclockwise by the clockwise rotation of the air valve shaft 34, the connecting link 420 will be moved to the right causing the connecting link 422 to rotate in a counterclockwise direction causing the air valve shaft 36 to rotate in a counterclockwise direction. The size of the sector gears 408 and 410 and the orientation and size of the connecting links 414, 420 and 422 are selected so that the venturi plates 24 and 26 will rotate in opposite directions to provide an opening through which air flows into the carburetor.

The metering cam 402 has a fuel metering surface 422, along a peripheral edge. The metering surface 422 is a variable radius surface whereby the distance between the pivot axis of the pivot shaft 404 and a selected point along the metering surface 422 varies. As will be fully described hereafter, the metering surface 422 is a cam surface by which the metering valve is variably opened or closed to allow fuel to flow from the fuel reservoir 76 into the fuel dispersion assembly 82.

Referring to FIGS. *6a* and *6b*, the metering rod 424 which extends through the metering valve housing 400, has a ballbearing 425 on one end positioned to bear against the metering surface 422. Ring seals 428 are positioned in one or more circular grooves 429 in the metering rod 424 to form a seal between the metering valve housing 400 and the metering rod 424, to prevent fuel from leaking out of the fuel reservoir 76.

The end 430 of the metering rod 424 which extends into the fuel reservoir 76 has a generally concave shape. A ball valve 432 is captivated in the concave depression in the end 430 by a suitable ball valve compression spring 433 between the ball valve 432 and the bottom 436 of a metering passageway 438. The metering passageway 438 provides the outlet for the fuel from the reservoir 76.

In accordance with a preferred embodiment of the invention, a valve adjustment sleeve 440 is movably inserted in a sleeve insertion cavity 439. The valve adjustment sleeve 440 is a cylindrically shaped member having an outside diameter which is just slightly smaller than the inside diameter of the sleeve insertion cavity 439 to allow movement therebetween. The metering passageway 438 then extends through the valve adjustment sleeve 440 along its central axis. The inside surface 444 of the metering passageway 438 is defined by a torus shaped, downwardly extending, curved mouth transitioning to a straight-sided frusto-conically tapered inner surface whereby the large diameter opening at the top nonlinearly decreases along the torus shaped mouth and thereafter linearly decreases towards the bottom 436 of the metering passageway 438.

A spring 446 is positioned between the bottom surface 436 and the downfacing surface 447 of the valve adjustment sleeve 440.

Referring to FIG. 4 in conjunction with FIGS. *6a* and *6b*, a valve closure adjustment arm 448 is pivotally attached to the metering valve housing 400 in the fuel reservoir 76 by a pin 450 through one end of the arm 448. The arm 448 has a central orifice 451 therethrough with a pair of contact protrusions 452 and 454 extending downwardly on either side of the orifice 450 to come in contact with a top ring surface 456 of the valve adjustment sleeve 440. The other end of the valve closure adjustment arm 448 has a pair of upfacing contact protrusions 458 which bear against a contact disc 460 fixed to a central portion of a valve closure adjustment shaft 462. The valve closure adjustment shaft 462 extends through the fuel reservoir housing 400 with an adjustment end 464 extending through the top of the metering valve housing 400 and a lower threaded end 466. The lower threaded end 466 is threaded into a threaded hole 467 which extends into the metering valve housing 400 in the bottom of the fuel reservoir 76.

The end of the valve closure adjustment arm 448 with the upstanding contact protrusions 458 is forked so that the threaded end 466 will pass through the forked end of the valve closure adjustment arm 448 and be threaded into the metering valve housing 400.

In operation, fuel is metered from the fuel reservoir 76 through the metering passageway 438 and out through a plurality of sleeve exit ports 470 in the valve adjustment sleeve 440 into an exit passageway 472 which connects to the fuel dispersion assembly 82 to be described hereafter. The amount of fuel which is allowed to pass through the metering passageway 438 will depend on the amount of space between the ball valve 432 and the inside surface 444 of the metering passageway 438. The amount of space between the ball valve 432 and the tapered cylindrical surface 444 will depend upon the vertical positioning of the ball valve 432. Thus, if the metering rod 424 is positioned in a generally raised position, as shown in FIG. *6b*, the space between the ball valve 432 and the inside surface 444 will be increased allowing a greater amount of fuel to flow from the reservoir 76 into the metering passageway 438 and out through the exit passageway 472. By contrast, if the metering rod 424 is moved downwardly, the ball valve 432 will move downwardly to a position which is closer to the inside cylindrical tapered surface 444 thereby limiting the amount of fuel which can flow into the metering passageway 438 and out through the exit passageway 472.

Figure 6A:
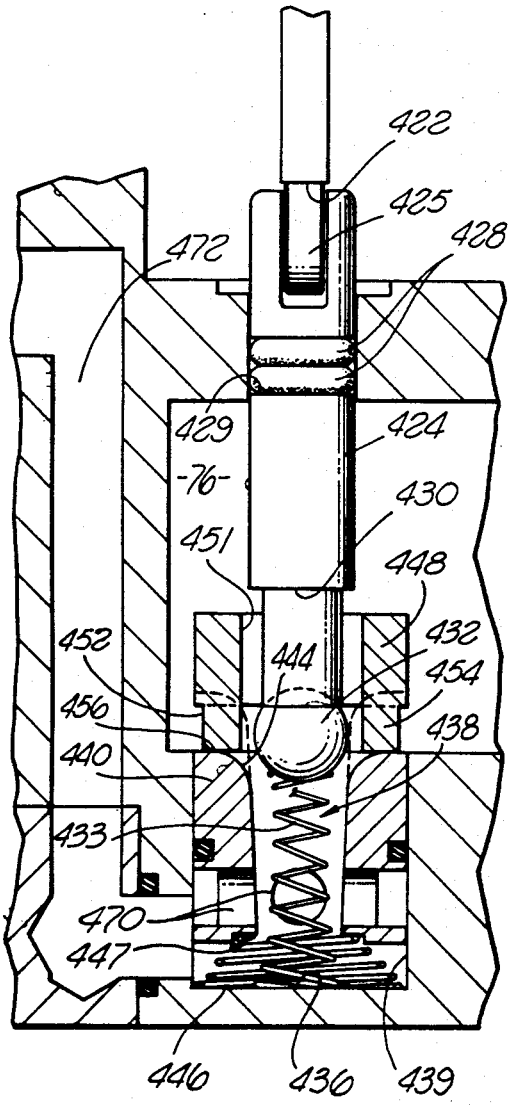
FIGS. 6*a* and 6*b* are partial side cross-sectional plan views through section 6—6 of FIG. 4 illustrating the maximum closure position of the metering ball valve and the maximum open position of the metering ball valve respectively in accordance with the invention.
Figure 6B:
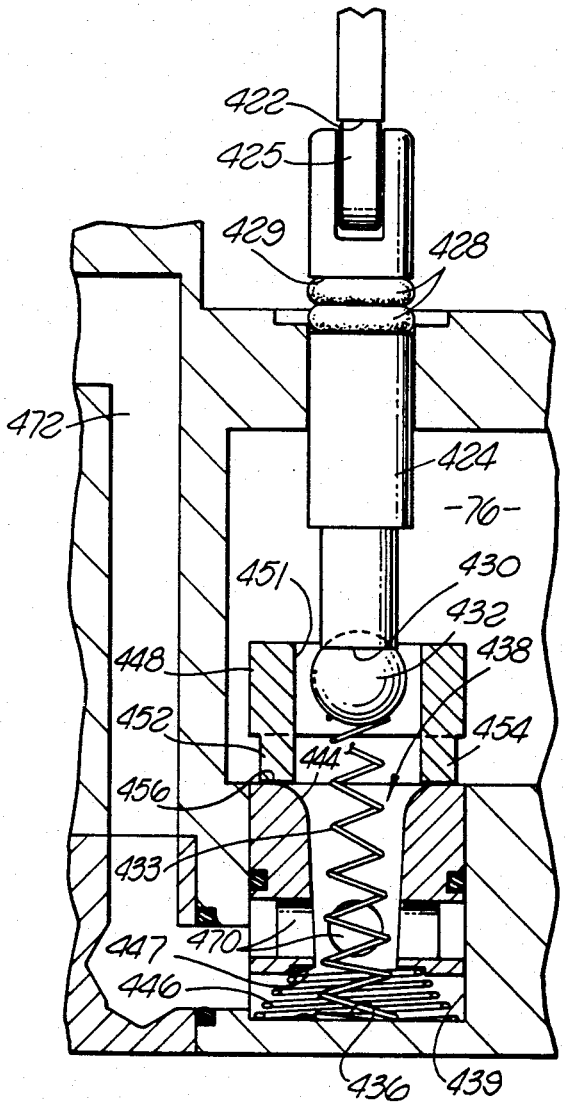

As can be seen from FIG. 4, the vertical position of the metering rod 424 is determined by the point along the metering surface 422 at which the roller bearing 425 makes contact because of the variable radius of the metering surface 422. Thus, when the metering cam 402 is in a position whereby it is rotated to its maximum extent in the clockwise direction, the metering rod 424 will be forced into the fuel reservoir 76 causing the ball valve 432 to limit the area of the opening between the ball valve 432 and the inside surface 444. This position corresponds to an idle or engine-off position whereby only a limited quantity of fuel is allowed to pass into the fuel dispersion assembly 82. When the metering cam 402 is rotated counterclockwise to its most extreme angular position, the metering rod 424 will move upwardly in response to the force of the spring 434 applied against the ball valve 432 and hence against the metering rod 424. The resultant position of the ball valve 432 will be as shown in FIG. 6*b*.

In accordance with one specific illustrative embodiment of the invention, the radius of the metering surface 422 varies up to 2/10 of an inch so that the metering rod 424 will have a range of movement of 2/10 of an inch. Of course, it will be appreciated that the specific contour of the metering surface 422 and the amount by which the metering rod 424 is longitudinally movable will change depending upon the particular vehicle and configuration of the carburetor. The specific shape of the metering surface 422 is best determined empirically by testing the engine performance which results from variations in the ball valve positioning at various throttle openings.

In addition to varying the shape of the metering surface 422, the valve adjustment sleeve can be adjusted relative to the sleeve insertion cavity 438 by rotating the valve closure shaft 462 at the adjustment end 464. Such rotation causes the valve closure adjustment shaft 462 to move inwardly or outwardly relative to the metering valve housing 400 which in turn causes the valve closure adjustment arm 448 to pivot clockwise or counterclockwise about the pivot pin 450. Referring to FIG. 6*a* as the valve closure adjustment arm 448 pivots, for example, counterclockwise about the pivot pin 450, the central portion of the valve adjustment arm 448 with the protrusions 452 and 454 will move upwardly away from the ring surface 456. However, because of the force applied against the bottom of the valve adjustment sleeve 440 by the spring 446, the entire valve adjustment sleeve 440 will move upwardly relative to the sleeve insertion cavity 439. This will of course bring the surface 444 closer to the surface of the ball valve 432 causing a relative closing of the space between the ball valve 432 and the surface 444 restricting the flow of fuel from the fuel reservoir 476 into the metering passageway 438. Thus, it can be seen that by rotating the valve closure adjustment shaft 462 in one direction or the other, the steady state flow of fuel from the fuel reservoir 76 into the metering passageway 438 can be adjusted.

Figure 10:
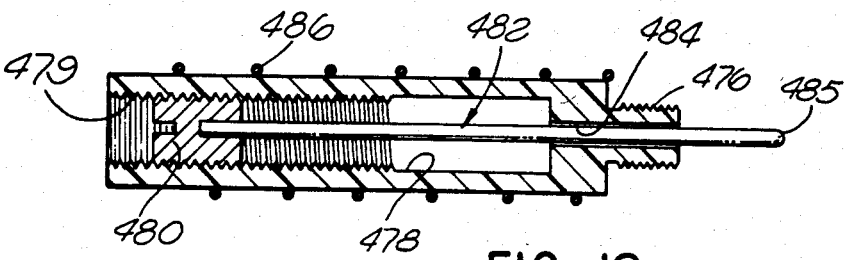
FIG. 10 is a cross-sectional side view of a cold start ball valve control mechanism.

Referring to FIG. 4 in conjunction with FIG. 10, one embodiment of the present invention may incorporate a cold start actuation mechanism 473 for pivoting the metering valve closure adjustment arm 448 about the pivot pin 450 to increase the opening between the ball valve 432 and the surface 444 to enable greater fuel flow into the metering passageway 438 (FIG. 6A) when the engine is cold and thereafter, when the engine is warm, to cause the valve closure adjustment arm 448 to pivot back to a normal, more restrictive position.

To incorporate such a cold start actuation mechanism 473, a flange or other upward protrusion 472 is joined to or formed integrally with the valve closure adjustment arm 448 near the pivot pin 450. An inside threaded orifice 470 is then provided through the housing 400 for receiving the cold start mechanism 473.

Referring to FIG. 10, the cold start actuation mechanism 473 includes a cylindrical body or housing 474 made out of a heat sensitive plastic material such as Delrin (TM) which expands when heated and contracts when cooled. The body 474 has an outside threaded boss 476 at one of its ends with a central passage 478 extending through the body 474. The end of the passage 478 remote from the outside threaded boss 476 includes an inside thread 479 into which a setscrew 480 is inserted. One end of a rod 482 is then attached such as by press fitting to the setscrew 480 and extends through the passage 478 and out through the outside threaded boss 476. The rod 482 is preferably made of tungsten to assure that the rod does not expand significantly when compared to the expansion characteristics of the body 474. The tungsten rod 482 is spaced from the inside surface of the plastic body 474 along its entire length. Hence, a space 484 will exist between the outside surface of the tungsten rod 482 and the inside surface of the plastic body 474 adjacent to the boss 476.

Finally, a heating wire 486 is wound around the plastic body 474. The heating wire may be any of a number of well known materials. One end of the heating wire 486 is coupled to the ignition switch so that whenever the ignition switch is turned on electricity flows through the heating wire thus causing the plastic body 474 to be heated. The other end of the heating wire is grounded to the carburetor body.

Referring again to FIG. 4, the outside threaded boss 476 of the cold start actuation assembly 473 is inserted into the threaded orifice 470 with the end 485 of the tungsten rod 482 pressing against the flange 472.

In operation, the setscrew 480 is adjusted while the engine is cold so that the end of the tungsten rod 482 presses against the flange 472 to cause the valve closure adjustment arm 448 to rotate about the pin 450 in a clockwise direction thereby increasing the opening between the ball valve 432 and the surface 444 of the metering passageway 438. Consequently, when the engine is cold a greater amount of fuel will flow from the reservoir 76 into the fuel dispersion assembly to be injected into the air-fuel mixing passageway 16 causing a richer air-fuel mixture. When the ignition is turned on however, the heating wire 486 will begin to cause the plastic body 474 of the cold start assembly to warm which causes the plastic body to expand. As the plastic body 474 expands, the setscrew 480 will move outwardly away from the body of the carburetor thus pulling the end 485 of the tungsten rod 482 away from the flange 472 and allowing the valve adjustment arm 448 to move in a counterclockwise direction. This movement decreases the area between the ball valve 432 and the surface 444 of the metering passageway 438. Hence, the air/fuel mixture will become leaner since less fuel will be injected into the air/fuel mixing passageway. However, by this time the engine will be warm and the cold start mechanism will no longer be required.

Referring to FIG. 8, the above-described cold start assembly 473 can also find application in place of the idle screw 724 to automatically increase the idle rate while the engine is cold and thereafter gradually reduce the idle speed as the engine warms. In such an embodiment, the cold start assembly 473 will be mounted on the side of the carburetor with the tungsten rod 482 bearing against the stop flange 720.

Referring again to FIG. 2, fuel which passes through the metering valve assembly 78 enters an exit passageway 80, which is connected to the fuel dispersion assembly 82. The fuel dispersion assembly 82 includes a dispersion bar which extends transversely across the throat 20 of the mixing passageway 16 in a direction transverse to the direction of airflow through the mixing passageway 16. Referring to FIGS. 3*a* and 3*b* in conjunction with FIG. 2 the dispersion bar has a generally diamond shaped cross section with the width along the direction of air flow through the mixing passageway 16 being greater than the width transverse to the direction of the air flow through the mixing passageway 16. The dispersion bar 200 is positioned in the air flow passageway so that air impinging upon the forward surfaces of the dispersion bar 200 facing towards the air intake opening 18 will accelerate in velocity because the opening through which the air must pass narrows.

Extending through the center of the dispersion bar is a flow passageway 204 extending the length of the dispersion bar 200. The flow control passageway 204 is opened at both of its ends and is connected at one of its ends to the exit passageway 80, utilizing suitable leakproof seals such as the O-ring 206. The other end of the flow control passageway opens into a fuel pressure control assembly 84 to be described hereafter, with leakage being prevented by a suitable O-ring seal 208. The dispersion bar 200 has a plurality of fuel dispersion slits 210 positioned at spaced locations along the transverse apexes 66 and 68 of the dispersion bar 200. The fuel dispersion slits 210 are oriented to expel fuel into the throat of the air fuel mixing passageway in a direction transverse to the flow of air through the mixing passageway 16. The slits 210 are provided to extend through the dispersion bar 200 to the flow passageway 204.

In order to control the flow of fuel through the rectangular fuel dispersion slits 210 so that the fuel pressure in the flow control passageway 204 is maintained substantially constant, a suitable spool valve assembly is incorporated in the flow control passageway 204. Specifically, the spool valve assembly includes a spool shaft 212 having a central fuel transport passageway 214 extending therethrough. The spool shaft 212 is open-ended allowing for the flow of fuel. The first end 216 of the spool shaft 212 is positioned adjacent to the end of the exit passageway 80 to receive fuel therefrom. Fuel passing into the fuel transport passageway 214 is transferred into sections of the flow passageway 204 of the dispersion bar 200 through suitable dispersion orifices 218 which extend through the spool shaft 212 at spaced locations therealong.

The fuel spool shaft 212 also includes a plurality of spaced increased diameter regions 220 which have an outside diameter only very slightly less than the inside diameter of the flow passageway 204 so that fuel passing through the dispersion orifices 218 is prevented from flowing longitudinally along the flow passageway 204 by the regions of the increased diameter 220. The length of the cylindrical regions of increased diameter is sufficiently long so that the cylindrical regions of increased diameter 220 can be longitudinally moved to cover the fuel dispersion slits 210 thereby preventing the flow of fuel through those slits 210. In addition, the placement of the cylindrical regions of increased diameter along the spool shaft 212 is such that they will align with the slits 210 so that all of the slits are simultaneously being opened, closed or partially opened to the same degree as a consequence of movement of the spool shaft 212 in the flow passageway 204.

As previously indicated, the spool shaft 212 is positioned to move longitudinally in the flow passageway 204. To provide for such longitudinal movement, a suitable sleeve 222 may be inserted in the flow passageway 204 where the sleeve 222 has a polished interior surface over which the surface of the cylindrical regions of increased diameter 220 will slide smoothly.

A connecting rod 224 is pinned utilizing a pin 226 to the second end 228 of the fuel metering rod 212 in such a way that the connecting rod 224 extends into the fuel transfer passageway 214. The outside diameter of the connecting rod 224 is provided to be less than the inside diameter of the fuel transfer passageway 214 so that the fuel in the fuel transfer passageway 214 flows between the inside surface of the fuel transport passageway 214 and the outside surface of the connecting rod 224.

The other end of the connecting rod 224 is coupled in a conventional manner to the surface of a diaphragm 230 which is part of the fuel pressure control assembly 84. The fuel pressure control assembly 84 further comprises a housing 232 which is bifurcated by the diaphragm 230 to define a pressure regulation chamber 234 and a pressure adjustment chamber 236. Contained in the pressure adjustment chamber 236 is a spring 237 which is attached between the back of the diaphragm 230 opposite the surface to which the connecting rod 224 is attached and one end of an adjustment screw 238 which can be rotated clockwise or counterclockwise to adjust the compression of the spring 237.

The front of the housing 230 opposite the adjustment screw includes an externally threaded boss 244 which is threaded into a mating threaded hole 17 in the carburetor housing 12. The threaded boss 244 has an internal passageway whereby fuel flows through the fuel transfer passageway 214 into the center passageway of the threaded boss 244 whereby the pressure of the fuel is applied against the diaphragm 230.

It will be seen therefore that the aforedescribed spool valve assembly will allow the fuel pressure in the fuel transfer passageway 214 to be maintained at a constant value. Rotation of the adjustment screw 238 clockwise or counterclockwise causes an increase or decrease in the compression of the spring against the back of the diaphragm 230.

In operation, if an increase in fuel flow into the transfer passageway 214 occurs, the diaphragm 230 will be deflected in a direction toward the adjustment screw 238 thus moving the cylindrically regions of increased diameter 220 to the right allowing more fuel to flow through the fuel dispersion slits 210.

Referring to FIGS. 7 and 8, the linkage between the vehicle throttle and the throttle valves 42 and 44 is illustrated. Specifically, the vehicle throttle is interconnected by a suitable linkage, such as cables or the like (not shown) to a throttle link 700 which is affixed to a shaft 702 which is pivotally mounted to the outside of one end of the carburetor housing 12 opposite the end of the housing to which the metering assembly 78 is affixed. Also fixed to rotate with the shaft 702 is a first sector gear 704. The first sector gear 704 meshes with a second sector gear 706 which is fixed to one end of the throttle mounting shaft 50 extending through the end of the carburetor housing 12. A throttle link 708 is pivotally attached between an edge region of the first sector gear 704 and a pivotal link 710 which is attached to the end of the throttle shaft 52 by a suitable coupling pin 712. As with the throttle mounting shaft 50, the throttle mounting shaft 52 extends through the end of the carburetor housing 12.

A connecting flange 714 extends from the pivot link 710 with an anticipator 716 attached thereto. The other end of the anticipator 716 is coupled to one end of an anticipator link 718 with the other end of the anticipator link 718 affixed to the end of the air valve shaft 36 extending through the end of the carburetor housing 12.

In order to enable the venturi plates to open more rapidly than the throttle plates (a mode of operation desired for rapid acceleration), the length b of the link 714 is selected to be longer than the length a of the link 718. In the present invention the link 718 will be about two times the length b of the link 714. This will assure that the venturi plates will open approximately twice as rapidly as the throttle valves when the throttle valves are opened rapidly. Of course the ratio between the length of the links 714 and 718 may be varied without departing from the spirit of the invention.

Figure 9:
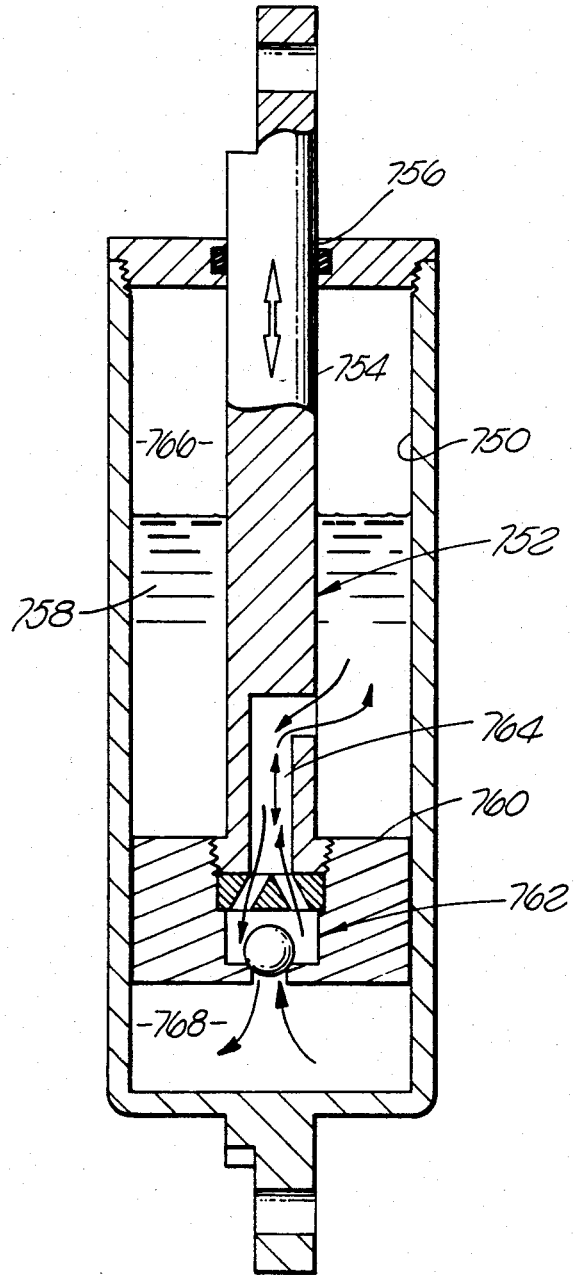
FIG. 9 is a cross-sectional view taken on line 9—9 of FIG. 7.

Referring to FIG. 9 the anticipator 716 may be a plunger-like mechanism such as that shown in FIG. 7 comprising a housing 750 with a plunger 752 extending thereunto. The plunger 752 has a connecting shaft 754 which extends through one end of the housing with a seal 756 positioned between the housing 750 and the shaft 754 to prevent fluid 758 in the housing 750 from leaking out of the housing 750. The other end of the shaft has a cylindrical region 760 which bifurcates the interior of the housing 750 into a first portion 766 and second portion 768 substantially inhibits fluid flow between the two parts of the interior chamber of the housing 750. A one-way ball valve 762 is then provided in a passageway 764 extending through the plunger 752 which inhibits the flow of fluid 758 from the first portion 766 into the second portion 768 but allows free fluid flow from the second portion 768 to the first portion 766 of the interior chamber of the housing 750. Therefore, pulling substantially greater resistance will occur in pulling the plunger 752 and the housing 750 apart as will occur in pushing the plunger 752 and housing 750 together. The venturi plates will thus be free to move in response to the air vacuum created by the engine unless the throttle is moved rapidly causing the venturi plates to open even more rapidly as previously described.

As shown in FIG. 8, the sector gear 704 has a stop flange 720 on one of its sides. A throttle stop pin 722 is attached to extend from the housing 12 of the carburetor 10 with a stop adustment screw 724 adjustably inserted to extend through a threaded hole in the throttle stop pin 722. The throttle stop 722 is positioned on the end of the carburetor housing 12 so that the end of the stop adjustment screw 724 will abut against the stop flange 720 of the sector gear 704.

The above-described stop adjustment screw 724, throttle stop 722 and stop flange 720 allow for the adjustment of the closed position of the throttle valves 42 and 44. Thus, by screwing the stop adjustment screw 724 into the throttle stop 722 against the stop flange 720 the sector gear 704 will be rotated in a counterclockwise direction causing the throttle valves 42 and 44 to be opened, that is, rotated in a counterclockwise and clockwise direction respectively.

A throttle spring 726 is attached to a coupling pin 728 on a flange 730 extending from one side of the sector gear 706 with the other end of the throttle spring 726 attached to a coupling pin 732 between the throttle link 708 and the pivot link 710. The throttle spring 726 is maintained in tension so that the throttle valves 42 and 44 will return to a closed position when pressure is released from the throttle of the vehicle. Thus, unless the throttle of the vehicle is being depressed or otherwise actuated in an affirmative way the throttle valves 42 and 44 will rotate to a normally closed position.

OPERATION

The operation of the above-described carburetor is as follows:

When the vehicle throttle is initially actuated by depressing or otherwise moving the throttle to increase the running speed of the internal combustion engine, the throttle link 700 shown in FIG. 7 moves in a counterclockwise direction causing the sector gear 704 to move in a counterclockwise direction, the sector gear 706 to move in a clockwise direction, and the throttle valve 44 to rotate in a clockwise direction. The throttle link 708 pushes against the pivotal link 710 causing the pivotal link 710 and the throttle valve 42 to move in a counterclockwise direction. Such a movement results in increased tension on the throttle spring 726.

As the pivot link 710 rotates in a counterclockwise direction, the connecting flange 714 pulls down against the anticipator 716 which pulls against the anticipator link 718 if the throttle moves rapidly enough causing the link 718 to rotate in a clockwise direction which in turn causes the venturi plate 24 to pivot downwardly in a clockwise direction to enable fuel to begin to be injected into the air/fuel mixing passageway to start the engine. Otherwise, the venturi plate 26 will move in response only to the air vacuum in the air-fuel mixing passageway.

Referring to FIG. 4, the various sector gears and linkages 408, 410, 414, 402, 420 and 422 interconnect to cause a simultaneous counterclockwise pivoting of the venturi plate 26.

Therefore, when the throttle link 700 is pivoted in a counterclockwise direction, the throttle valves 42 and 44 will each pivot from a closed position to an increasingly open position thereby opening the throat of the air-fuel mixing passageway as illustrated in FIG. 3*b*. The resultant partial air vacuum caused by the engine will cause the venturi plates to likewise open. As the venturi plate 26 pivots in a counterclockwise position, the air valve shaft 36 to which the venturi plate is fixed will pivot, thus causing the cam region 521 (FIG. 5) to rotate pressing the cam surface 521 against the ball bearing 518 resulting in an opening of the O-ring valve 512.

Fuel will thus flow into passageway 506 through the O-ring fuel valve 512 and into the fuel intake passageway 74 filling the fuel reservoir 76 (FIG. 4) with fuel. Simultaneously, and depending on the amount by which the air valve shafts 34 and 36 are rotated, the metering cam 402 (FIG. 4) will rotate causing the metering surface 422 to move against the ball bearing 426 which causes the metering rod 424 (FIG. *6a*) to move from its fully inserted position to an increasingly open position.

The flow of fuel through the metering valve assembly 78 will thus increase as the throttle position is increasingly actuated. The fuel then flows through the exit passageways 472 and into the fuel dispersion assembly 82 (FIGS. 2 and *3a*) where the fuel is discharged through fuel dispersion slits 210 in the fuel dispersion bar 200 into the throat or narrowest part of the air-fuel mixing passageway. It will be appreciated, therefore, that the greater the degree of rotation of the venturi plates 24 and 26, the more fuel will be transferred to the fuel dispersion assembly 82.

Additional control over the amount of fuel actually passing through the fuel dispersion slits 210 is provided by the spool valve arrangement previously described. Thus, the fuel dispersion slits will be variably opened and closed in response to variations in the volume of the fuel applied against the fuel pressure control assembly 84. The fuel discharged from the slits will therefore always be discharged at a constant pressure. In one embodiment the preferred fuel pressure was four pounds per square inch while the compression of the spring 237 of the fuel pressure control assembly was between one and one and one-half pounds.

Referring again to FIG. 7, a richer air fuel mixture is provided in accordance with the invention using the anticipator 716. Specifically, when rapid acceleration is desired, it is preferable to have a richer fuel-to-air ratio for a short period of time. Such a richer fuel-air mixture is achieved by accelerating the opening of the venturi plates 24 and 26 relative to the opening of the throttle valves 42 and 44. Thus, if the throttle link 700 is moved rapidly in a counterclockwise position, such as when a rapid acceleration is desired, there is an immediate and rapid force applied against the anticipator 716, which will pull the anticipator 716 at one of its ends downward. The other end of the throttle damper 716 attached to the damper link 718 will immediately follow the movement of the end of the anticipator 716 attached to the flange 714. A short time thereafter, the air flow vacuum will cause the end of the anticipator attached to the link 718 to move up thus allowing the venturi plates 24 and 26 to stabilize in their proper operating position. However, the anticipator will have provided an accelerated rotation of the venturi plates 24 and 26 to allow more fuel to be injected into the air-fuel mixing passageway 16 without the normal air flow between the venturi plates 24 and 26.

While various embodiments and features of the present invention have been described, it will be appreciated that many changes and alterations can be made to conform to particular engines and performance criteria without departing from the intent of the invention in its broadest aspects. It is therefore the purpose of the following claims to encompass all such modifications and changes as fall within the true intent and scope of the invention.

What is claimed is:

1. A fuel flow metering apparatus for a carburetor responsive to activation of an operator controlled throttle for mixing a fuel from a storage tank with air for burning in an internal combustion engine, the carburetor defined by a carburetor housing having an air intake opening, an air-fuel discharge opening and an air-fuel mixing passageway extending through the housing between the air intake opening and the air discharge opening for drawing air in through the air intake opening in response to a partial vacuum created by the operation of the internal combustion engine and discharging a metered amount of the fuel in the air-fuel mixing passageway, the air-fuel mixture resulting therefrom being drawn through the air-fuel discharge opening into the engine in response to the partial vacuum, the direction of air flow through the housing defining a flow direction; a fuel reservoir housing defining therein a fuel reservoir having a fuel input port and a fuel discharge port; a fuel dispersion assembly mounted to the housing for dispersing the fuel form the reservoir into the air passing through air-fuel mixing passageway;

a fuel flow metering means for variably regulating the flow of fuel from the fuel reservoir into the fuel dispersion assembly in response to the magnitude of the partial vacuum created by the operation of the internal combustion engine comprising;

a pivotal metering cam having a variable radius metering surface;

a metering rod extending through the fuel reservoir housing and having a first end postioned to bear against the metering surface and a second end positioned in the fuel reservoir;

a ball valve; and a first spring positioned in the fuel discharge port to press against the ball valve whereby the ball valve is held against a second end of the reservoir metering rod, the first spring further pressing the reservoir meeting rod to bear against the metering surface, the fuel discharge port having therein a closure surface defined by a generally torus-like, inwardly narrowing, curved mouth transitioning to a frusto-conically tapered inner surface whereby pivotal movement of the metering disk causes longitudinal movement of the metering rod to variably increase and decrease the spacing between the ball valve and the closure surface whereby the flow of fuel through the fuel discharge port is increased or decreased respectively.

2. The carburetor fuel flow metering apparatus of claim 1 further comprising metering valve closure adjustment means comprising:

a valve adjustment sleeve having a central metering passageway therethrough, the surface of the central metering passageway defining the closure surface, the valve adjustment sleeve having a bottom end and a top end, the valve adjsutment sleeve being moveably positioned in the fuel discharge port;

a second spring positioned in the fuel discharge port for pressing against the bottom end of the valve adjustment sleeve;

a valve adjustment arm having a first end pivotally attached in the fuel reservoir, a central region positioned for pressing against the top end of the valve adjustment sleeve, and a second end; and a valve adjustment shaft extending into the fuel reservoir for contacting the second end of the valve adjustment arm, the valve adjustment shaft being adjustable into the fuel reservoir to variably press against the second end of the valve adjustment arm whereby the valve adjustment arm pivots about its first end and the central region variably presses against the top end of the valve adjustment sleeve to adjustably move the valve adjustment sleeve in the fuel discharge port to vary the space between the ball valve and the closure surface.

3. The fuel flow metering apparatus of claim 1 further comprising metering valve closure adjustment means for adjustably moving the closure surface relative to the ball valve for variably increasing and decreasing the spacing between the ball valve and the closure surface.

4. A carburetor responsive to activation of an operator controlled throttle for mixing a fuel from a storage tank with air for burning in an internal combustion engine comprising:

a carburetor housing having an air intake opening, an air fuel discharge opening and an air-fuel mixing passageway extending through the housing between the air intake opening and the air-fuel discharge opening for drawing air in through the air intake opening in response to a partial vacuum created by the operation of the internal combustion engine and discharging a metered amount of the fuel in the air-fuel mixing passageway, the air-fuel mixture resulting therefrom being drawn through the air-fuel discharge opening into the engine in response to the partial vacuum, the direction of air flow through the housing defining a flow direction;

a fuel reservoir housing defining therein a fuel reservoir having a fuel input port and a fuel discharge port;

a fuel dispersion means coupled for receiving fuel from the fuel discharge port and metering the fuel for discharge into the air-fuel mixing passageway;

an air valve means positioned to pivot in the air intake opening and coupled to pivot in response to the operator controlled throttle; and an on/off flow control valve coupled between the fuel storage tank and the fuel reservoir for enabling fuel to flow from the fuel storage tank into the reservoir, said on/off flow control valve coupled for being responsive to pivoting of the air valve means.

* * * * *